US007726551B2

(12) United States Patent
Abbott

(10) Patent No.: US 7,726,551 B2
(45) Date of Patent: Jun. 1, 2010

(54) CONTAINER WITH FOLDING LID

(75) Inventor: Phillip G. Abbott, Louisville, TN (US)

(73) Assignee: Shamrock Cups, LLC, Louisville, TN (US)

( * ) Notice: Subject to any disclaimer, the term of this patent is extended or adjusted under 35 U.S.C. 154(b) by 0 days.

(21) Appl. No.: 12/105,725

(22) Filed: Apr. 18, 2008

(65) Prior Publication Data

US 2009/0261152 A1 Oct. 22, 2009

(51) Int. Cl.
*B65D 3/20* (2006.01)

(52) U.S. Cl. ..... 229/404; 229/5.5; 229/138

(58) Field of Classification Search ..... 229/138–140, 229/5.5, 404

See application file for complete search history.

(56) References Cited

U.S. PATENT DOCUMENTS

| | | | | |
|---|---|---|---|---|
| 411,096 | A | 9/1889 | Eaton | |
| 727,723 | A | 5/1903 | Webb | |
| 1,284,728 | A | 11/1918 | Luellen | |
| 2,028,566 | A | 1/1936 | Seipel et al. | |
| 2,047,804 | A | 7/1936 | Shapiro | |
| 2,047,891 | A * | 7/1936 | Scott | 229/138 |
| 2,266,948 | A | 12/1941 | Barbieri | |
| 2,457,198 | A | 12/1948 | Bell | |
| 2,563,352 | A | 8/1951 | Morse | |
| 2,917,215 | A | 12/1959 | Psaty et al. | |
| 3,071,308 | A | 1/1963 | Lange | |
| 3,526,352 | A * | 9/1970 | Swett | 229/138 |
| 3,549,081 | A * | 12/1970 | Nelson | 229/138 |
| 3,580,468 | A | 5/1971 | McDevitt | |
| 3,612,346 | A | 10/1971 | Schneider | |
| 3,799,425 | A * | 3/1974 | Fanter | 229/126 |
| 3,809,310 | A | 5/1974 | Vander Lugt | |
| 4,289,267 | A | 9/1981 | Mayea | |
| 4,712,725 | A | 12/1987 | Moore | |
| 4,730,766 | A * | 3/1988 | Fear | 229/137 |
| 4,850,528 | A * | 7/1989 | Hanus | 229/138 |
| 5,203,490 | A | 4/1993 | Roe | |
| 5,205,473 | A | 4/1993 | Coffin, Sr. | |
| 5,226,585 | A | 7/1993 | Varano | |
| 5,326,019 | A | 7/1994 | Wolff | |
| 5,363,982 | A | 11/1994 | Sadlier | |
| 5,425,497 | A | 6/1995 | Sorensen | |
| 5,460,323 | A | 10/1995 | Titus | |
| 5,518,168 | A | 5/1996 | Mayer | |
| 5,531,375 | A | 7/1996 | Palm | |
| 5,547,124 | A | 8/1996 | Mueller | |
| 5,636,785 | A * | 6/1997 | Kalberer et al. | 229/137 |

(Continued)

OTHER PUBLICATIONS

Design Drawings—Figures 1-5 (4 pages) The dates of these publications are not known, but it is requested that they be considered as prior art for the purposes of examination.

(Continued)

*Primary Examiner*—Gary E Elkins
(74) *Attorney, Agent, or Firm*—Luedeka, Neely & Graham, PC

(57) ABSTRACT

A folding closure that is foldable to a closed orientation having a pair of gabled lid sections oriented to be linearly aligned and abutting one another in an end-to-end relationship and a pair of lateral lid sections oriented to be linearly aligned with one another and abutting opposite sides of the gabled lid sections.

8 Claims, 8 Drawing Sheets

U.S. PATENT DOCUMENTS

| | | | | |
|---|---|---|---|---|
| 5,660,326 | A | 8/1997 | Varano et al. | |
| 5,669,553 | A | 9/1997 | Smith | |
| 5,676,306 | A | 10/1997 | Lankin et al. | |
| 5,697,550 | A | 12/1997 | Varano et al. | |
| RE35,830 | E | 6/1998 | Sadlier | |
| 5,826,786 | A | 10/1998 | Dickert | |
| D402,197 | S | 12/1998 | Poulin | |
| D406,058 | S | 2/1999 | Allmon | |
| 5,909,842 | A * | 6/1999 | Allmon | 229/404 |
| 5,921,465 | A | 7/1999 | Garton | |
| 5,964,400 | A | 10/1999 | Varano et al. | |
| 6,109,518 | A | 8/2000 | Mueller et al. | |
| 6,176,420 | B1 | 1/2001 | Sarson et al. | |
| 6,286,754 | B1 | 9/2001 | Stuer et al. | |
| D459,652 | S | 7/2002 | Beutler | |
| D495,209 | S | 8/2004 | Tranfaglia et al. | |
| D588,453 | S | 3/2009 | Glade | |
| D592,504 | S | 5/2009 | Jacobsson | |
| 2006/0118608 | A1 | 6/2006 | Stahlecker | |
| 2007/0117702 | A1 | 5/2007 | Okushita et al. | |

OTHER PUBLICATIONS

Heat-Insulating Cup, Japanese Patent Abstract, Publication No. 2000095228 A, Published Apr. 4, 2000, Application No. 10266417, Filed Sep. 21, 1998, Inventor Gerhard Kraus.

International Search Report PCT/US08/68534 (3 pages) dated Jun. 17, 2009.

* cited by examiner

CONTAINER WITH FOLDING LID

FIELD

This disclosure relates to the field of containers. More particularly, this disclosure relates to a disposable container formed from foldable sheet material which provides an integrated lid having improved construction.

BACKGROUND

Improvement is desired in the construction of enclosable containers, particularly disposable drink cups. For example, coffee and other drinks are typically sold in paper or plastic cups having a separate lid that is friction fit to the cup. The use of separate lids is undesirable for logistics and performance reasons. For example, a separate inventory of lids is required and the lids often fail to provide adequate protection against leakage or spillage. In many instances, the lid is not fully seated onto the cup when installed or does not remain fully seated and simply grasping the cup when full will cause spillage. In the event the cup is dropped, the lid typically unseats and most if not all of the contents escape.

Accordingly, a need exists for improvements in the enclosure of containers, especially disposable containers such as paper or plastic cups.

SUMMARY

The above and other needs are met by a folding closure. When folded to a closed orientation, a lid structure is formed that includes a pair of gabled lid sections oriented to be linearly aligned and abutting one another in an end-to-end relationship and a pair of lateral lid sections oriented to be linearly aligned with one another and abutting opposite sides of the gabled lid sections.

The folding closure is particularly suitable for providing a folding lid for a container, with the interior of the container being accessible when the closure is unfolded and the closure substantially enclosing the interior of the container when the closure is folded to a closed orientation.

In one embodiment, a container is provided that includes a sidewall and a folding closure both formed from a one-piece blank. The folding closure is located adjacent an edge of the blank adjacent the sidewall and is configured to provide a substantially open passage in an unfolded orientation and to provide a substantially closed structure in a folded orientation. The closed structure includes a pair of gabled lid sections oriented to be linearly aligned and abutting one another in an end-to-end relationship, and a pair of lateral lid sections oriented to be linearly aligned with one another and abutting opposite sides of the gabled lid sections.

In another aspect of the disclosure, a container blank is provided. The blank includes a foldable sheet material having a foldable closure portion defined adjacent an edge of the sheet material. The foldable closure portion has a plurality of first fold segments, a plurality of second fold segments, and a plurality of third fold segments. The first fold segments extend from the edge of the sheet material to an intersection with one of the second fold segments and the closure portion is void of any of the third fold segments intermediate at least one pair of adjacent and spaced apart ones of the first fold segments. The third fold segments each extend diagonally from the edge of the sheet material to an intersection of two of the second fold segments and one of the first fold segments.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
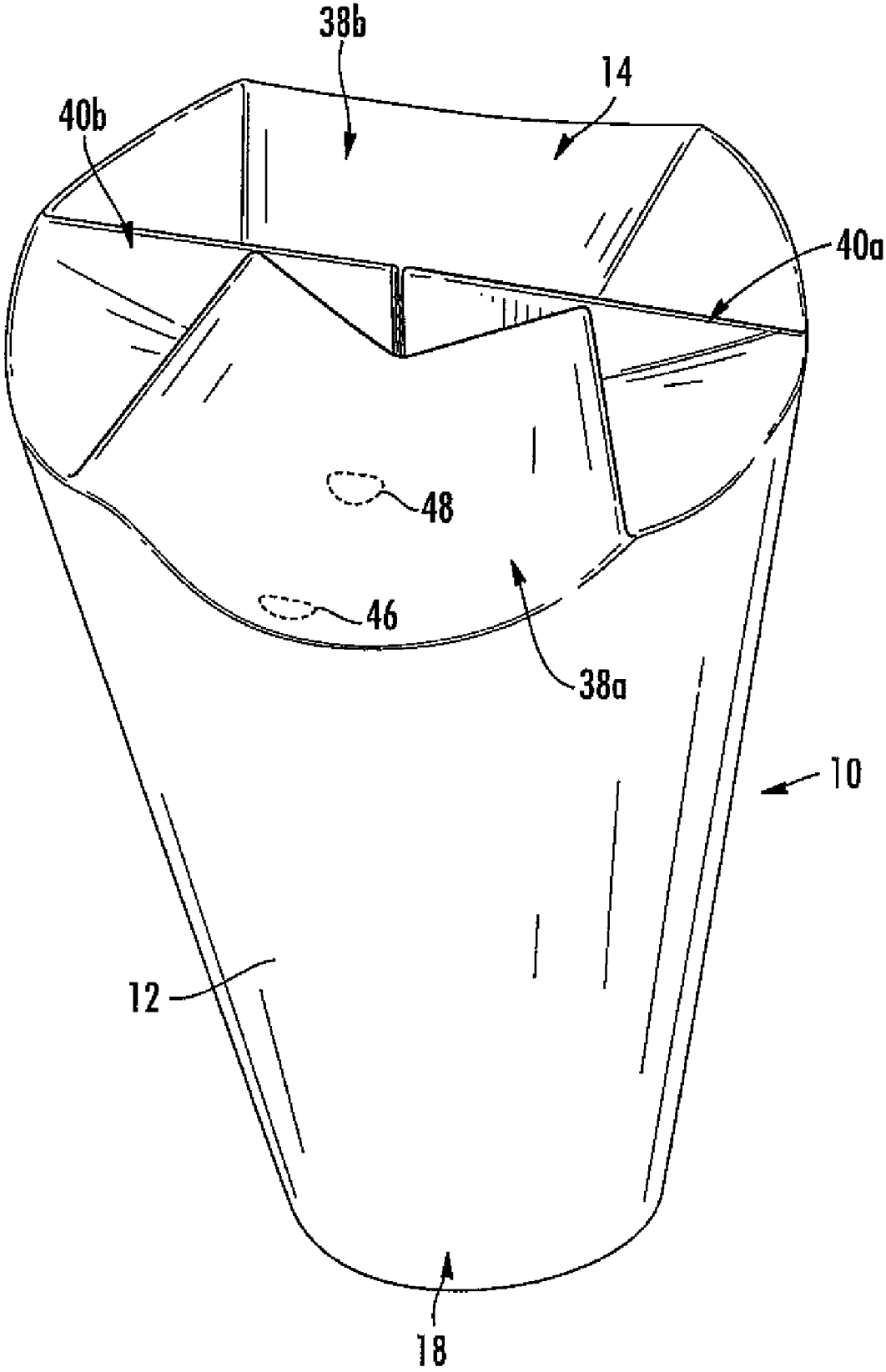
FIG. 1 is perspective view of a container according to a preferred embodiment of the disclosure shown in a closed condition.
Figure 2:
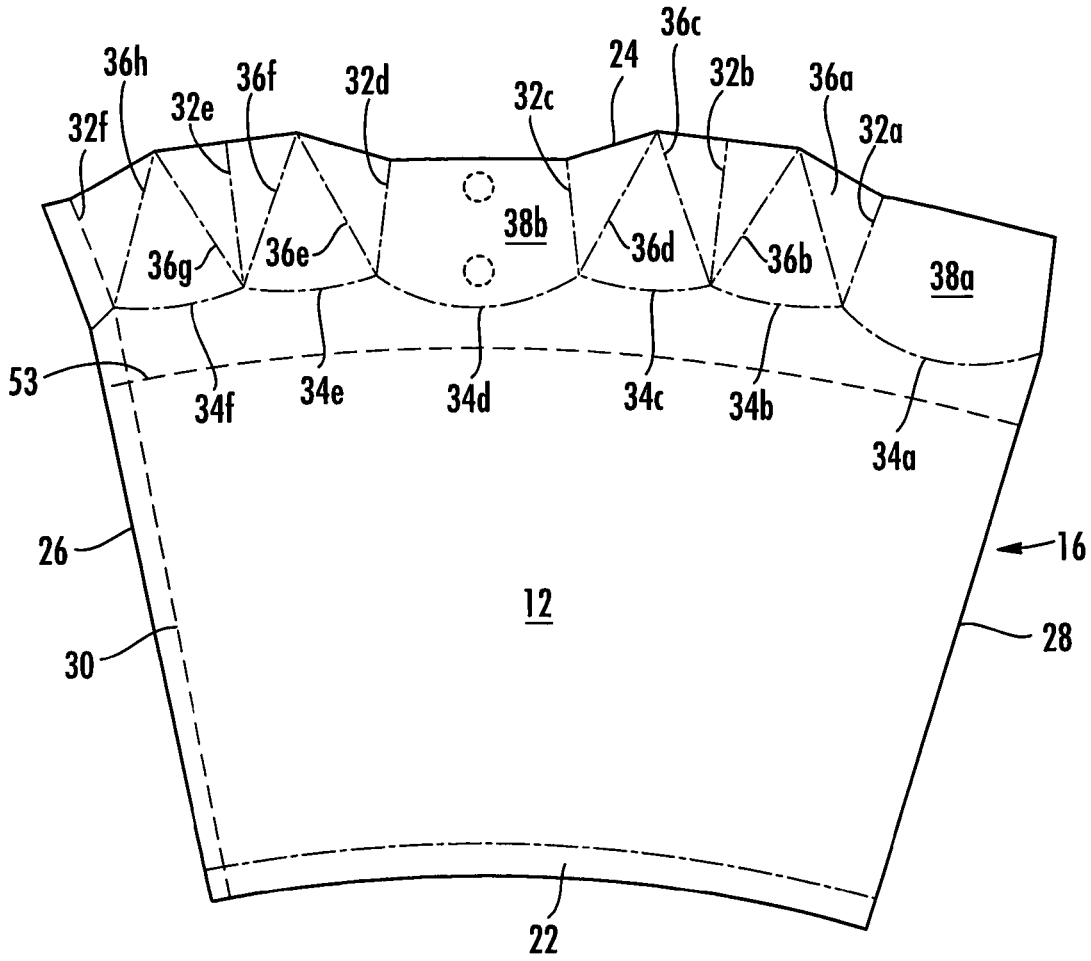
FIG. 2 is a blank for providing the sidewall and lid of the container of FIG. 1.

With reference to the drawings, the disclosure relates to a container 10 having a sidewall 12 and a folding closure or lid 14 both formed from a one-piece blank 16 (FIG. 2).

The sidewall 12 may also be used to provide a bottom or other enclosing surface needed opposite the lid 14. However, to provide a bottom 18 to the container 10 that supports the container 10 in an upright orientation, it is preferred to use a separate blank 20 to provide the bottom 18. It will also be understood that the blank 20 or other structure for forming the bottom 18 may be included with the blank 16 so as to have a container made of a single blank. Likewise multiple blank sections may be used and joined. Additionally, while described in connection with the preferred embodiment of providing a disposable container, it will be understood that the containers may alternatively be reusable.

With reference to FIG. 2, the blank 16 is a one-piece blank made of a foldable sheet material, such as paperboard material of the type conventionally used in the manufacture of paper cups. The blank 16 may be made of other sheet materials, including plastics of the type used to make plastic cups. The blank 16 described herein is configured for making the container 10 in the shape of a drinking cup. However, it will be understood that the container 10 (and hence the blank 16) may be otherwise shaped, yet still provide the desired configuration of the folding closure 14. For example, the container 10 may be configured such that the sidewalls provide a generally square or rectangular configuration. The containers may be suitable for a variety of uses, such as serving and storing consumables and non-consumables.

To render the container 10 such that the sidewall 12 provides a generally tapered cylindrical structure, the blank 16 is shaped to have a bottom edge 22, an upper edge 24, and a pair of opposite side edges 26 and 28. The bottom edge 22 and the upper edge 24 are preferably upwardly bowed, that is the bottom edge 22 bowing toward the upper edge 24 and the upper edge 24 is similarly bowed away from the bottom edge 22 and parallel thereto. The side edges 26 and 28 are linear and extend from each end of the bottom edge 24 to the upper edge 24. However, the length of the bottom edge 22 is less than the length of the upper edge 24, such that the side edges 26 and 28 are not parallel. Thus, when the side edges 26 and 28 are overlapped when forming the blank 16 into the container 10, the sidewall 12 will resemble a tapered cylinder in shape. Dashed line 30 on the blank 16 indicates an area that is overlapped by the opposite side as the blank is wrapped into a cone shape. The area defined between the edge 26 and the line 30 may also include a glue or adhesive to seal the overlapped portions together if desired. In this regard, however, it will be understood that the overlapped portions may be joined and sealed using conventional cup making techniques and equipment.

To provide the desired folding closure or lid 14, portions of the blank 16 adjacent the upper edge 24 are configured to include generally longitudinal fold segments 32*a*-32*f*, generally lateral fold segments 34*a*-34*f*, and angled fold segments 36*a*-36*h*. The fold segments described herein are desirably formed using automated machinery of the type commonly used for making paperboard or other sheet material blanks, and the container 16 thereafter formed using automated machinery of the type commonly used for converting blanks into containers.

The fold segments 32*a*-32*f*, 34*a*-34*f*, and 36*a*-36*h* cooperate to enable formation of the lid 14 into the closed orientation as seen in FIGS. 1 and 7-9 to define opposed and substantially lateral lid sections 38*a*-38*b* and opposed and substantially gabled lid sections 40*a*-40*b* located between the lateral lid sections 38*a* and 38*b*. The gabled lid sections 40*a* and 40*b* of the closed lid are linearly aligned and abut one another in an end-to-end relationship, with the lateral lid sections 38*a* and 38*b* linearly aligned with one another and abutting opposite sides of the gabled lid sections 40*a* and 40*b*. As will be noted, the lateral lid section 38*a* abuts both of the gabled lid sections 40*a* and 40*b* on one side thereof, and the lateral lid section 38*b* abuts both of the gabled lid sections 40*a* and 40*b* on the opposite side. Thus, the integrity of the closed orientation is maintained by the cooperating orientations of the gabled sections and the lateral sections.

As used herein, the term "substantially lateral" will be understood to mean that the lid sections 38*a* and 38*b* are positioned generally laterally relative to the sidewall 12. Thus, while the lid sections 38*a* and 38*b* may have a somewhat curved surface or a planar surface, each lies generally laterally relative to the sidewall 12 when the lid 14 is assembled to substantially enclose the container 10. The term "substantially gabled" will be understood to mean that the lid sections 40*a* and 40*b* include a generally triangular raised portion.

Fold segments 32*a*-32*f* are oriented to be substantially parallel to the length of the blank 16 and the side edges 26 and 28 of the blank 16. Each fold segment 32*a*-32*f* extends from the upper edge 24 to an intersection with one of the lateral fold segments 34*a*-34*f*. The fold segments 32*a*-32*f* are preferably substantially linear folds or creases formed on the blank 16 with the fold made so that the fold segment is oriented to be outward of the adjacent material portions of the blank 16.

Fold segments 34*a*-34*f* are oriented to be substantially parallel to the width of the blank 16 and the bottom edge 22 and the upper edge 24 of the blank 16. The fold segments 34*a*-34*f* are formed such that the segments of the upper edge 24 of the blank 16 extend generally toward the center of the container 10. As shown, the segments 34*a*-34*f* are generally scalloped or arcuate folds, however, it will be understood that they may also be linear folds. The use of arcuate folds is preferred for the segments 34*a*-34*f* to provide additional aesthetic appearance features to the lid 14 and also to provide generally curved surfaces 42 and 44 on the lid 14 which have been observed to offer surfaces comfortable to the mouth of a user when the container 10 serves as a drinking cup. In this regard, it is desirable to provide a perforated location that may be removed to define a slot or aperture 46 on one or both of the surfaces 42 or 44, for facilitating drinking of a beverage from the container 10. In addition, a perforated location may be provided to define an aperture 48 configured for accepting a straw or the like.

The fold segments 36*a*-36*h* are each preferably linear folds oriented to extend diagonally from the upper edge 24 to the intersection of two of the lateral fold segments 34*a*-34*f* and one of the longitudinal fold segments 32*a*-32*f*. For example, the segment 36*a* extends diagonally at an angle of about 45 degrees to the intersection of the lateral segments 34*a* and 34*b* and the longitudinal segment 32*a*. As will be noted (FIG. 2), the closure 14 is void of any of the fold segments 36*a*-36*h* intermediate at least one pair of adjacent and spaced apart ones of the fold segments 32*a*-32*f*. For example, no diagonal fold segments are located between the pair of adjacent and spaced apart fold segments 32*c* and 32*d*, which enables forming of the lateral lid section 38*b*.

Figure 3:
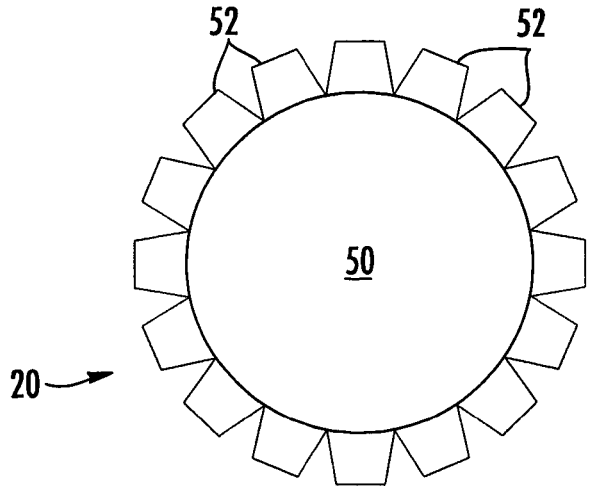
FIG. 3 is a blank for providing the bottom of the container of FIG. 1.
Figure 4:
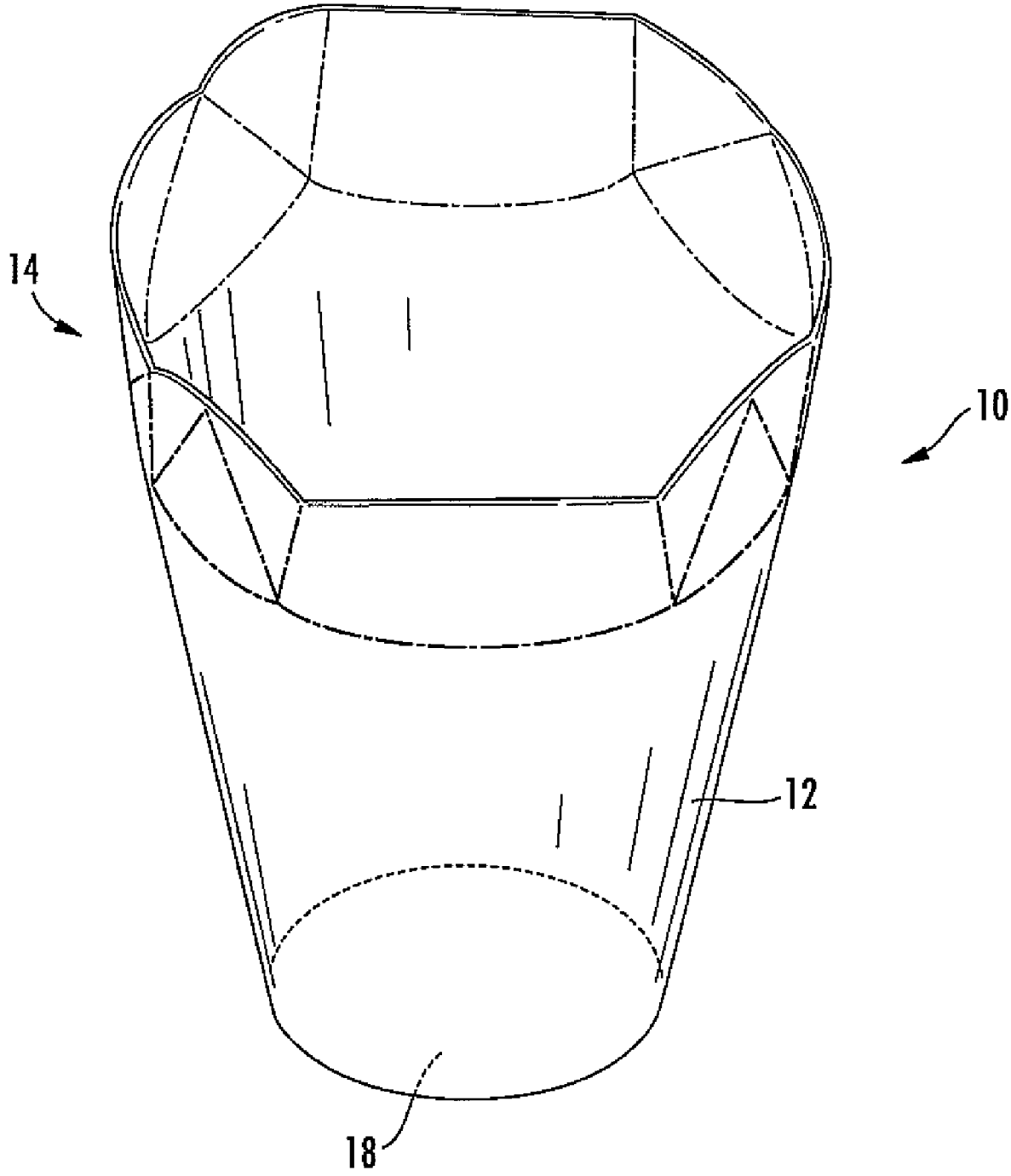
FIG. 4 shows the container as initially formed with an open-top.
Figure 5:
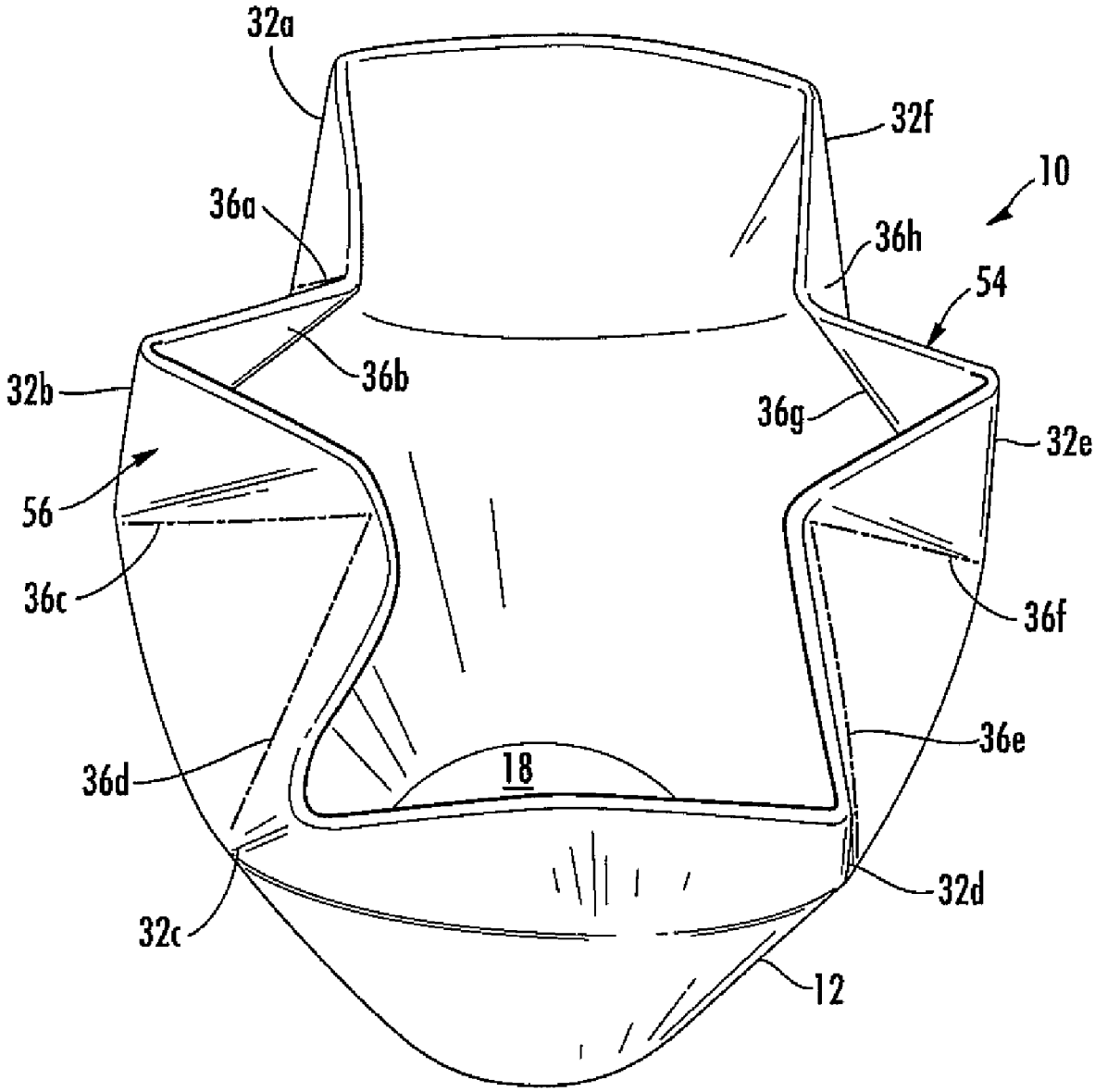
FIGS. 5-8 show steps in folding the lid of the container of FIG. 1 to provide the closed top condition.

With reference to FIG. 3, the blank 20 is a one-piece blank made of a foldable sheet material in the manner of the blank 16. The blank 20 includes a substantially circular portion 50 having a plurality of tabs 52 extending outwardly therefrom. In the manufacture of the container 10, the blank 20 is married with the blank 16 to form the container 10 as provided in an open top configuration, such as shown in FIG. 4, which provides a substantially open passage to the interior of the container 10 that facilitates loading of contents into the container. Also, the container 10 in the open top configuration of FIG. 4 may be readily stacked with a plurality of like containers for shipping, storage, and dispensing, for example, in a retail store or fast food setting.

To use the container 10, a user will obtain the container in the open configuration of FIG. 4 and fill the container through the open passage with a desired material, such as a beverage. In this regard, the container 10 may desirably include indicia, such as a fill line indicated by dashed line 53 to indicate a desired full level of the container 10 that cooperates with the lid 14. Next, the container 10 is configured as shown in FIGS. 5-8 to fold the segments 32*a*-32*f*, 34*a*-34*f*, and 36*a*-36*h* to form the lid 14 into the closed orientation as seen in FIGS. 1 and 7-9 and form the lid sections 38*a*-38*b* and 40*a*-40*b*.

With reference now to FIGS. 5-8, steps are shown in forming the lid 14. Beginning with FIG. 5, the sheet material is initially creased or folded about the fold lines 32*b* and 32*e* to define triangular portions 54 and 56 formed by the abutting triangular sections of the sheet material on opposite sides of the fold lines 32*b* and 32*e*, respectively.

Figure 6:
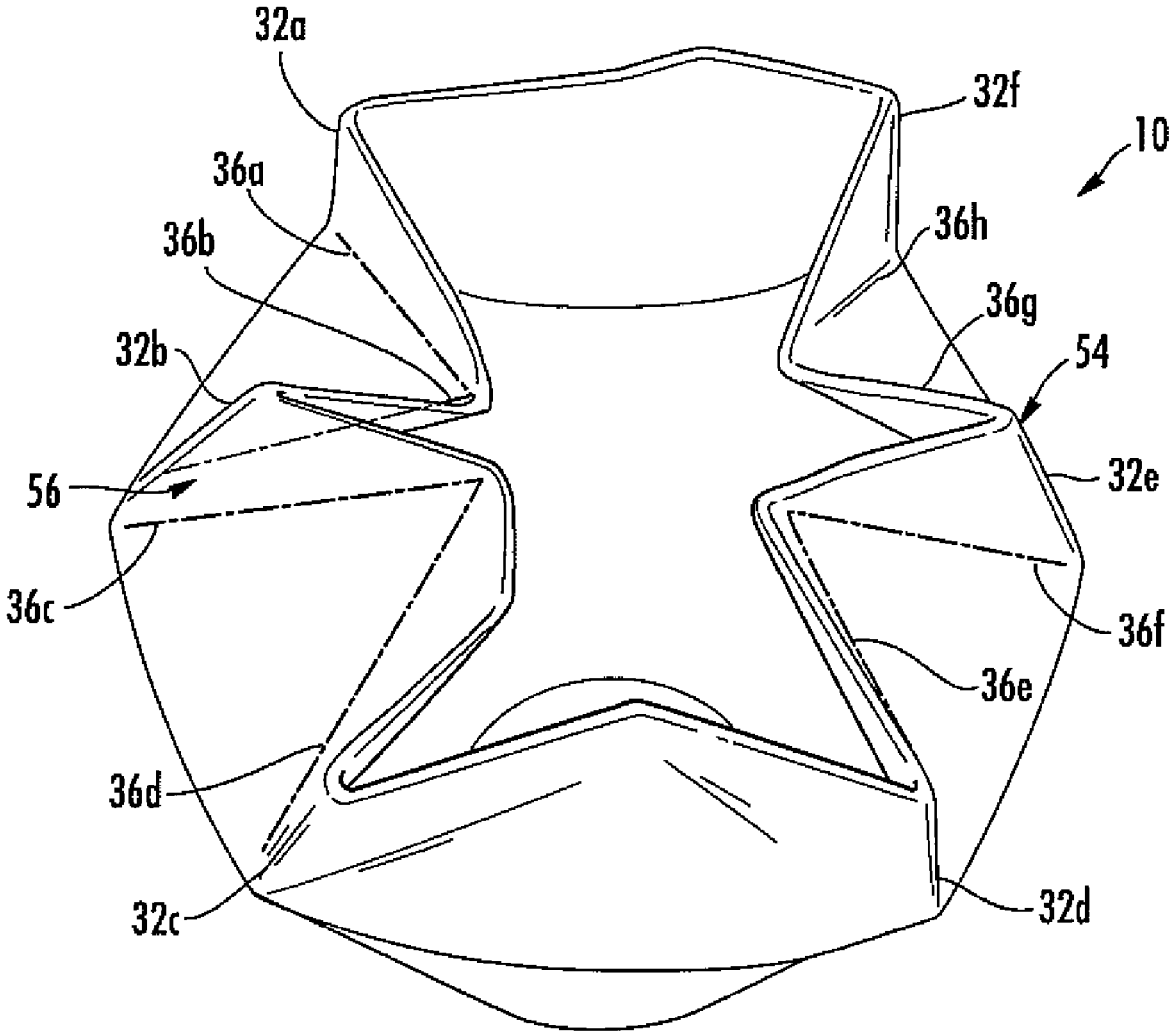
Figure 7:
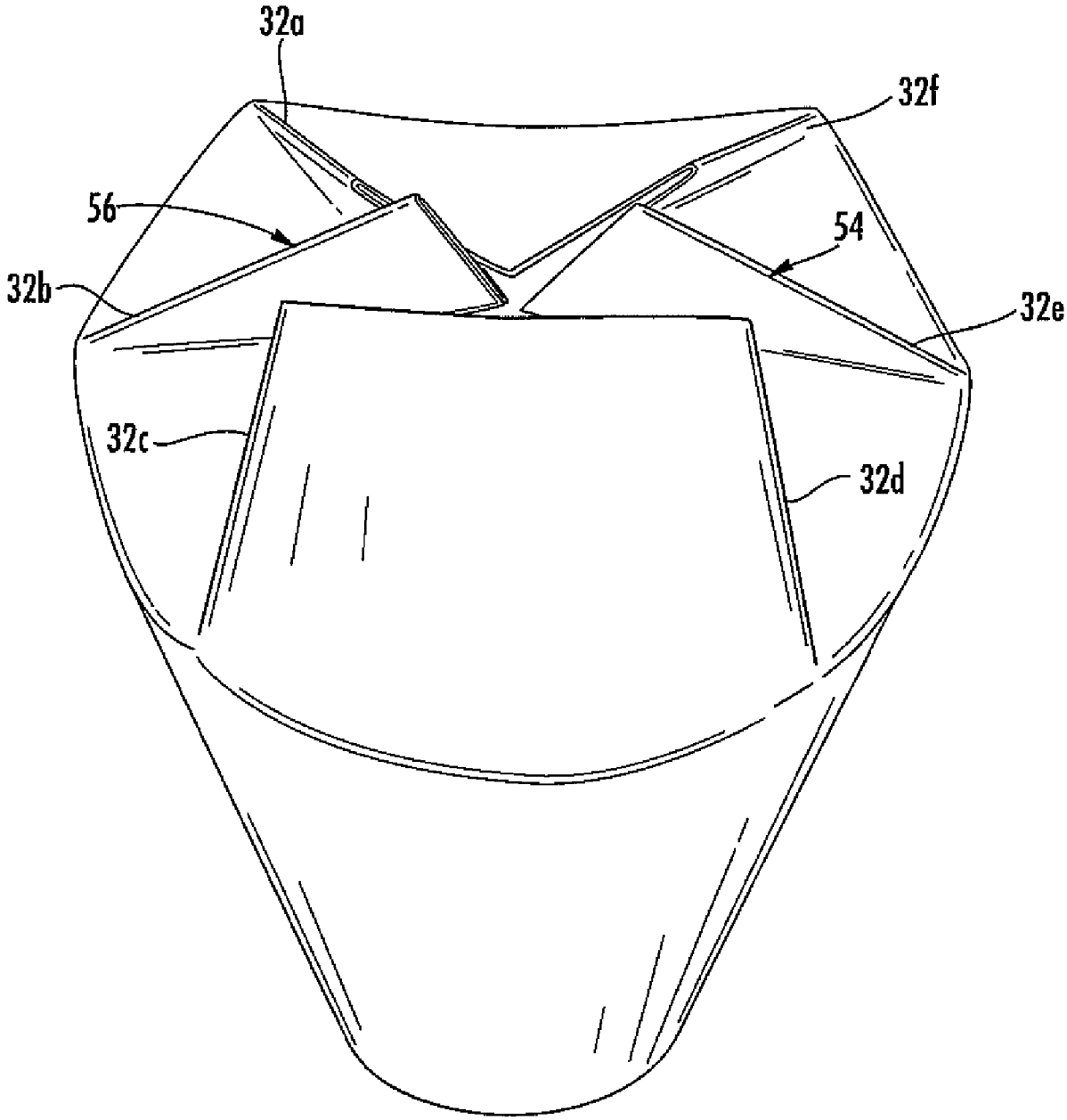

Next, as shown in FIG. 6, the sides of each triangular portion 54 and 56 are urged together and pressure applied to fold the triangular portions 54 and 56 toward one another in directions toward the center of the container 10. As the triangular portions 54 and 56 are urged toward one another, folding occurs along the remaining fold segments to the point as shown in FIG. 7 that a lower corner of each of the triangular portions 54 and 56 abut one another.

Figure 8:
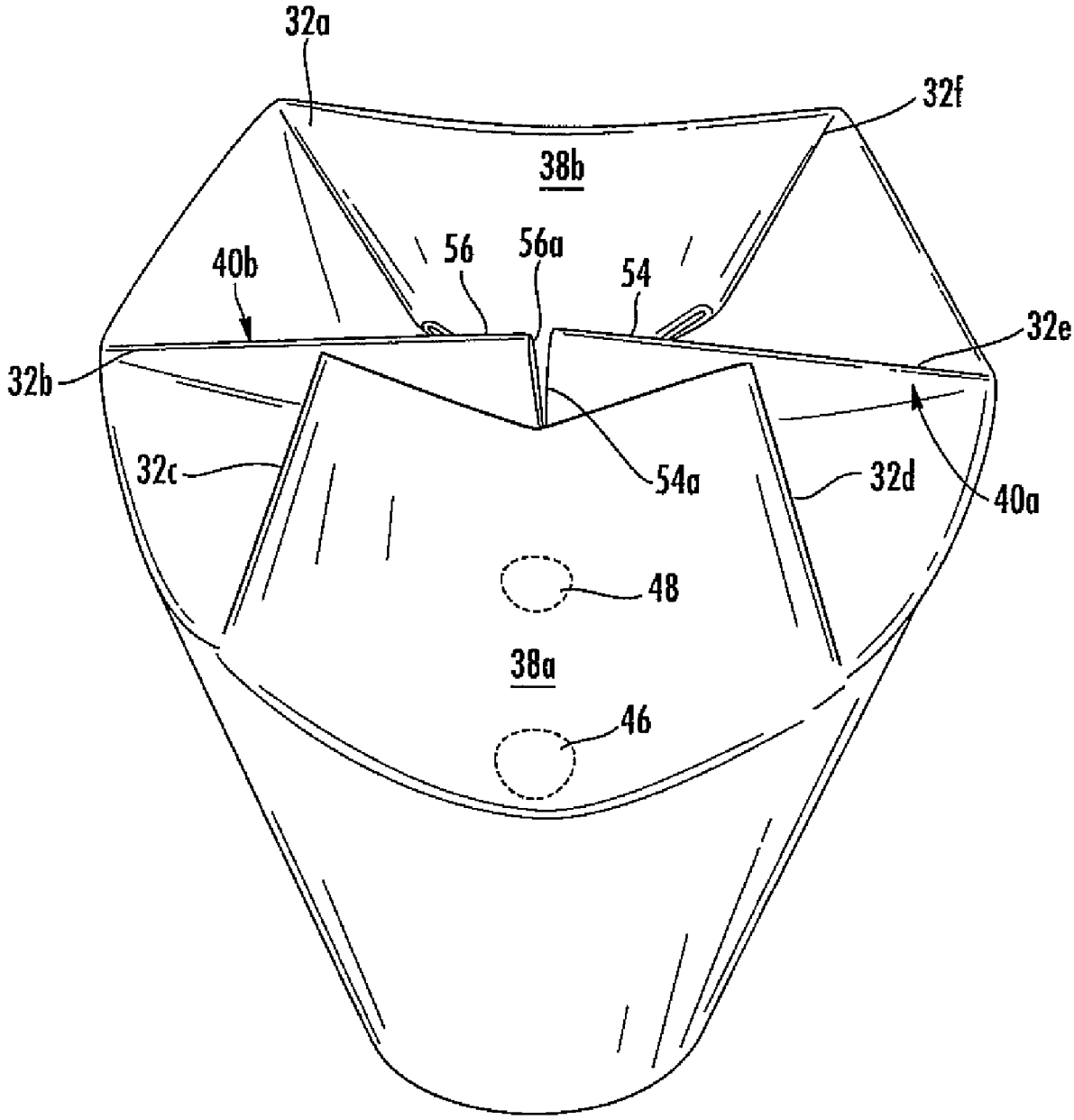
Figure 9:
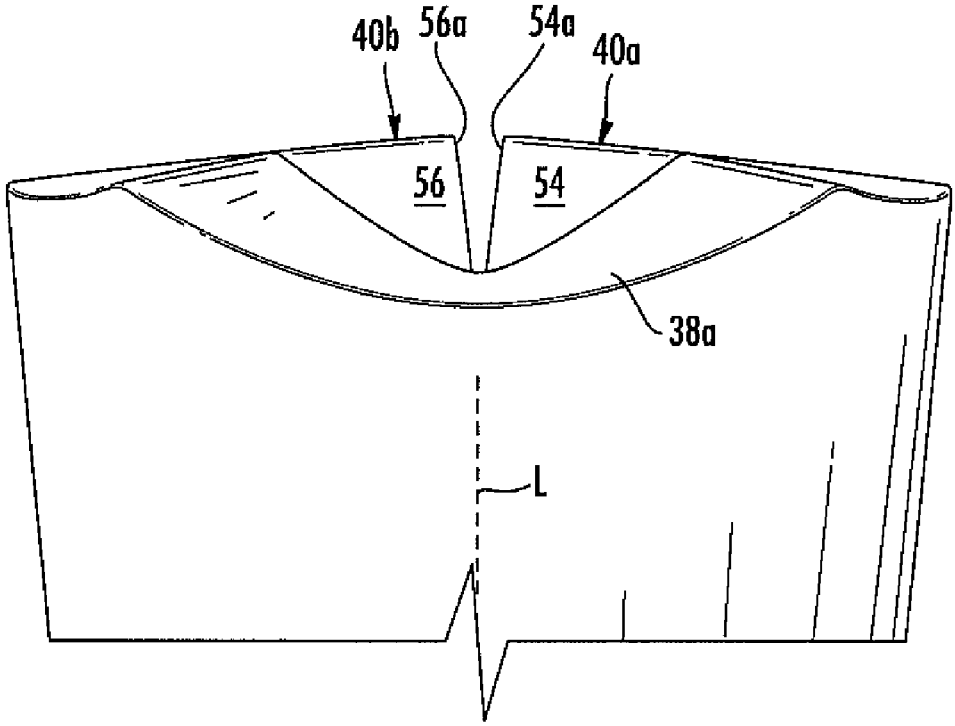
FIGS. 9 and 10 are opposite side views of the lid of the container of FIG. 1 in the closed condition.
Figure 10:
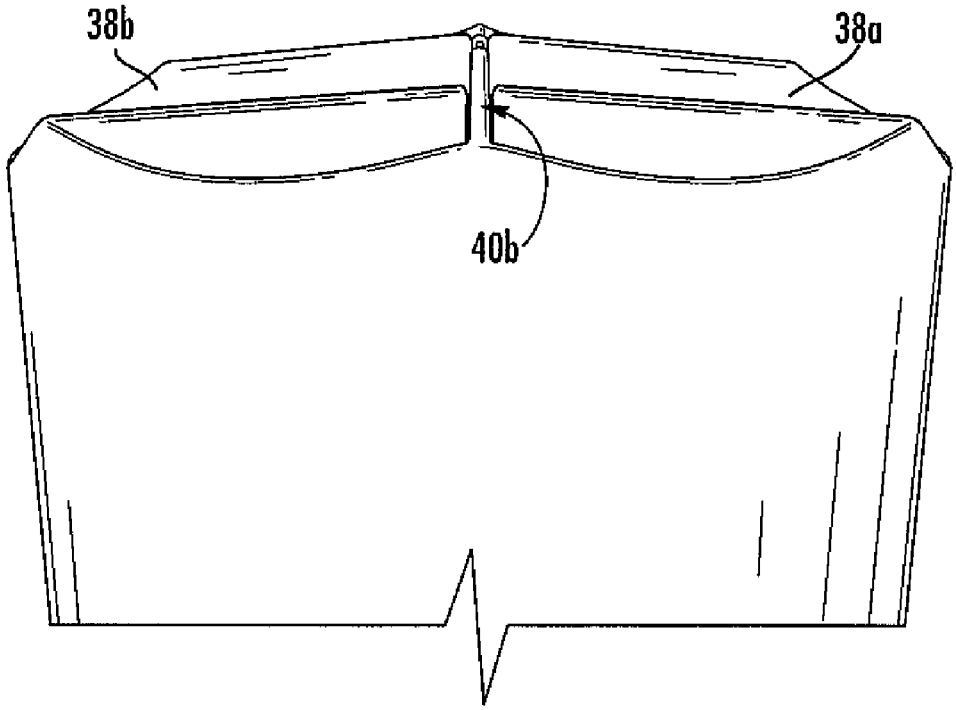

Next, as seen in FIG. 8, the triangular portions 54 and 56 are urged further until innermost edges 54*a* and 56*a*, respectively, bear against one another and are substantially aligned with longitudinal axis L of the container 10 (FIG. 9) to form the gabled lid sections 40*a* and 40*b*, with the lateral lid sections 38*a* and 38*b* being simultaneously formed to render the lid 14 in the closed condition (FIG. 10). Thus, the gabled lid sections 40*a* and 40*b* of the closed lid are linearly aligned and abut one another in an end-to-end relationship, with the lateral lid sections 38*a* and 38*b* linearly aligned with one another and abutting opposite sides of the gabled lid sections 40*a* and 40*b*.

It has been observed that the frictional end-to-end interface of the edges 54*a* and 56*a* reinforced by the abutting lateral lid sections 38*a* and 38*b* serves to maintain the lid 14 in the closed condition even when the container 10 is squeezed, tipped over, or dropped, with vastly improved resistance to leakage or spilling as compared to conventional container lids under similar conditions. For example, if the container 10 is dropped and lands on its side, then some minor spillage may occur if the container is substantially full through joints of the lid 14. However, it has been observed that the lid 14 typically remains substantially intact and that in less than full conditions very little spillage occurs since the joints are located proximate the center of the lid 14. Conversely, as will be appreciated, conventional lids seat around the perimeter of the container and upon the container being squeezed, dropped or tipped. Thus, when the seating of the lid is disrupted at any point around the perimeter, leakage readily occurs at such location and the lid typically becomes completely unseated and falls off, leaving no blockage to spilling.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A container, comprising a sidewall and a folding closure both formed from a one-piece blank, the folding closure being located adjacent an edge of the blank adjacent the sidewall and being configured to provide a substantially open passage in an unfolded orientation and to provide a substantially closed structure in a folded orientation, the substantially closed structure including a pair of gabled lid sections oriented to be linearly aligned and abutting one another in an end-to-end relationship, and a pair of lateral lid sections oriented to be linearly aligned with one another and each abutting opposite sides of the gabled lid sections, said lateral lid sections and said gabled lid sections interlocking to secure said folding closure in said folded orientation.

2. The container of claim 1, wherein the blank comprises a paperboard blank.

3. The container of claim 1, wherein the blank comprises a plastic blank.

4. The container of claim 1, wherein the container comprises a cup and further includes a bottom opposite the folding closure.

5. The container of claim 1, wherein the blank in a planar unfolded orientation has a length, a width, and an upper edge, and includes a plurality of longitudinal fold segments, a plurality of lateral fold segments, and a plurality of angled fold segments; wherein the longitudinal fold segments are each oriented to be substantially parallel to the length of the blank and extend from the upper edge of the blank to an intersection with one of the lateral fold segments which are each oriented to be substantially parallel to the width of the blank; and wherein the angled fold segments each extend diagonally from the upper edge of the blank to an intersection of two of the lateral fold segments and one of the longitudinal fold segments.

6. A container closure comprising a pair of gabled lid sections and a pair of lateral lid sections, the gabled lid sections oriented to be linearly aligned and abutting one another in an end-to-end relationship and the lateral lid sections oriented to be linearly aligned with one another and abutting opposite sides of the gabled lid sections, said lateral lid sections and said gabled lid sections interlocking to secure said lid sections in the oriented positions of the lid sections.

7. A container blank, comprising a foldable sheet material having a foldable closure portion defined adjacent an edge of the sheet material, the foldable closure portion having a plurality of first fold segments, a plurality of second fold segments, and a plurality of third fold segments; wherein the first fold segments extend from the edge of the sheet material to an intersection with one of the second fold segments, wherein the closure portion is void of any of the third fold segments intermediate at least one pair of adjacent and spaced apart ones of the first fold segments; and wherein the third fold segments each extend diagonally from the edge of the sheet material to an intersection of two of the second fold segments and one of the first fold segments, wherein the foldable closure portion is foldable to define a lid having a pair of gabled lid sections and a pair of lateral lid sections, and wherein the gabled lid sections are oriented to be linearly aligned and abutting one another in an end-to-end relationship and the lateral lid sections are oriented to be linearly aligned with one another and abutting opposite sides of the aligned gabled lid sections, said lateral lid sections and said gabled lid sections interlocking to secure said lid sections in the oriented positions of said lid sections.

8. The blank of claim 7, wherein the plurality of first fold segments comprises six first fold segments, the plurality of second fold segments comprises six fold segments, and the plurality of third fold segments comprises eight fold segments.

* * * * *